US006735992B2

(12) United States Patent
Hauer et al.

(10) Patent No.: US 6,735,992 B2
(45) Date of Patent: May 18, 2004

(54) DEVICE FOR MUTUALLY LOCKING TWO ELEMENTS, IN PARTICULAR A COVERING ELEMENT TO AN ELEMENT FORMING A SUPPORT FRAME

(75) Inventors: Jean-Claude Hauer, Saulxures lès Nancy (FR); Patrice Vauthier, Faulx (FR)

(73) Assignee: Saint-Gobain Pam CRD, Pont a Mousson Cedex (FR)

( * ) Notice: Subject to any disclaimer, the term of this patent is extended or adjusted under 35 U.S.C. 154(b) by 0 days.

(21) Appl. No.: 10/270,392

(22) Filed: Oct. 15, 2002

(65) Prior Publication Data

US 2004/0069024 A1 Apr. 15, 2004

(51) Int. Cl.[7] ..... B65D 55/14

(52) U.S. Cl. ..... 70/167; 70/168; 70/169; 70/171; 292/150; 292/65

(58) Field of Search ..... 70/167, 168, 169, 70/171, 172, 173; 292/140, 150, 152, 71, 63, 65, 64

(56) References Cited

U.S. PATENT DOCUMENTS

| | | | | | |
|---|---|---|---|---|---|
| 687,644 | A | * | 11/1901 | Milliron | 292/169.14 |
| 1,393,006 | A | | 10/1921 | Block | |
| 1,561,449 | A | * | 11/1925 | Armstrong | 70/168 |
| 1,774,307 | A | * | 8/1930 | Willig | 70/168 |
| 2,363,567 | A | * | 11/1944 | Blakeman | 292/6 |
| 2,608,085 | A | * | 8/1952 | Castle | 70/169 |
| 2,685,191 | A | * | 8/1954 | Ford | 70/169 |
| 4,784,415 | A | * | 11/1988 | Malaval | 292/144 |
| 4,964,755 | A | * | 10/1990 | Lewis et al. | 404/25 |
| 5,324,135 | A | * | 6/1994 | Smith | 404/25 |
| 6,199,414 | B1 | * | 3/2001 | Chang | 70/168 |

FOREIGN PATENT DOCUMENTS

| | | | |
|---|---|---|---|
| DE | 19604878 | A1 | 8/1997 |
| DE | 19621619 | A1 | 11/1997 |
| GB | 2129479 | A * | 5/1984 |

* cited by examiner

*Primary Examiner*—Anthony Knight
*Assistant Examiner*—Michael J. Kyle
(74) *Attorney, Agent, or Firm*—Sughrue Mion, PLLC

(57) ABSTRACT

To endow such a device, of the type with a bolt (1) actuated by a key (2), with a high level of tamper-proofing and security without compromising its simplicity and reliability, the device includes two bolt-guiding members (3, 4) carried by one of the two elements, and the bolt includes a key-inserting aperture (114), two guiding ramps (112, 113) cooperating with the guiding members, and a third guiding ramp (115) cooperating with the key (2) when the latter is inserted into the aperture (114), in order to selectively actuate the bolt (1) from a locking position to an unlocking position, and vice versa, by rotation of the key.

Figure 1:
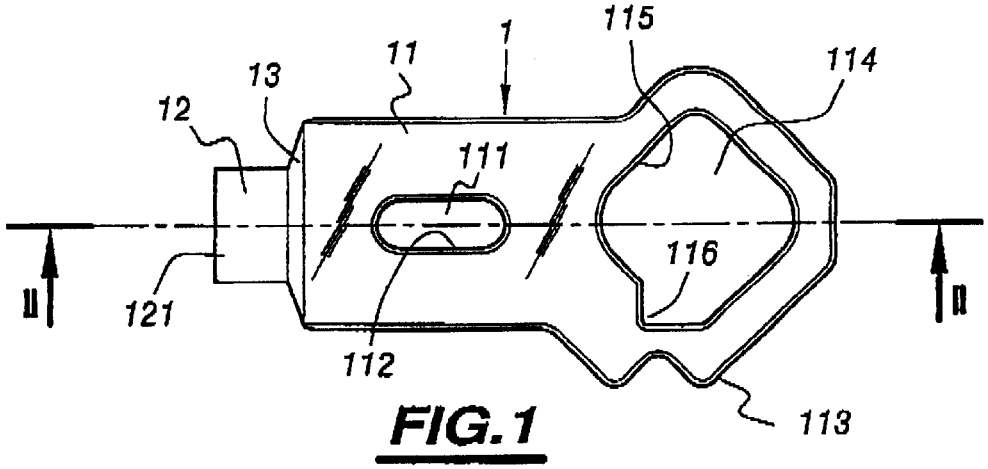

Use: devices for closing roadway or footway manholes, or underground technical chambers.

13 Claims, 4 Drawing Sheets

DEVICE FOR MUTUALLY LOCKING TWO ELEMENTS, IN PARTICULAR A COVERING ELEMENT TO AN ELEMENT FORMING A SUPPORT FRAME

The present invention relates to a locking device for mutually locking two elements, in particular a covering element to an element forming a support frame for this covering element, and applies for example to devices for closing shafts for inspecting an underground network, such as roadway or footway manholes, and to devices for closing technical inspection chambers of an underground cable network, such as trapdoors.

At present, there are numerous mechanical devices for making such covers or trapdoors tamper-proof, both of the lock type and of the latch type.

Locks include a mechanism which may be complex, causing the displacement of a bolt under a keeper by means of a specific key. They generally afford a relatively high level of security, but their complex mechanism, often situated in a environment which is corrosive and favourable to fouling, requires costly protection ("noble" materials and leaktight housing).

Latches are simple and economical devices which are not very sensitive to the environment and are generally actuable by a key rotationally driving a pivot with a special head integral with a bolt movable under a keeper. They generally afford a lower level of security, the head of the pivot being visible and capable of manipulation by conventional tools.

The object of the invention is to overcome these disadvantages by creating a device of the latch type which is not very sensitive to fouling and corrosion and can easily be made invisible to the outside and inaccessible to conventional tools, so as to afford a level of tamper-proofing and security comparable to that of a lock.

To this end, the invention relates to a locking device for mutually locking a first and second element, in particular a covering element to an element forming a support frame for the covering element, of the type including a movable bolt and a key for actuating the bolt, characterised in that it further includes two bolt-guiding members carried by one of the said first and second elements, and the bolt includes a key-inserting aperture, two guiding ramps adapted to cooperate with the two guiding members respectively, and a third guiding ramp adapted to cooperate with the contour of the key when the latter is inserted into the said aperture, in order to selectively actuate the bolt from a locking position to an unlocking position or from an unlocking position to a locking position, by rotation of the key.

The fact that the actual latch consists of few members also makes it very economical.

The locking device according to the invention may further have one or more of the following characteristics:

- one of the bolt-guiding members is carried by the first element and is formed by a member for securing the bolt to the first element, and the guiding ramp adapted to cooperate with this member is a wall of an oblong hole which is made in the bolt and into which the securing and guiding member is inserted;
- the securing and guiding member is a screw, the body of which is passed through the oblong hole and carries a locknut situated under the bolt;
- the other bolt-guiding member is carried by the first element and formed by a wedge-shaped finger, and the guiding ramp adapted to cooperate with this member is a region of a lateral edge of the bolt including an indentation forming a receptacle for the finger;

- the wedge-shaped finger is in one piece with the cover and extends in a manner projecting from a bottom face thereof;
- the third guiding ramp adapted to cooperate with the contour of the key consists of the lateral wall of the aperture, this lateral wall being adapted to cooperate with a key bit when the latter is inserted into the aperture;
- the aperture has an indentation, one edge of which forms an abutment for the bit when the bolt is in the unlocking position;
- the bit has a notch adapted to come into engagement with a boss in the shape of a circular crown surrounding a hole for inserting the key, made in the cover and situated facing the aperture, this boss projecting into the aperture and also cooperating with the third guiding ramp;
- the hole has a frustoconical shape flared towards the outer face of the cover and adapted to cooperate with a complementary frustoconical surface of the key, so as to ensure the rotational guidance of the key;
- the frustoconical hole has a major diameter significantly smaller than the aperture; and
- the key includes, at the base of a shank, a collar intended to bear on the cover, and the region for connection of the bit to the collar has a frustoconical surface adapted to cooperate with a frustoconical surface of a hole of the cover.

Figure 2:
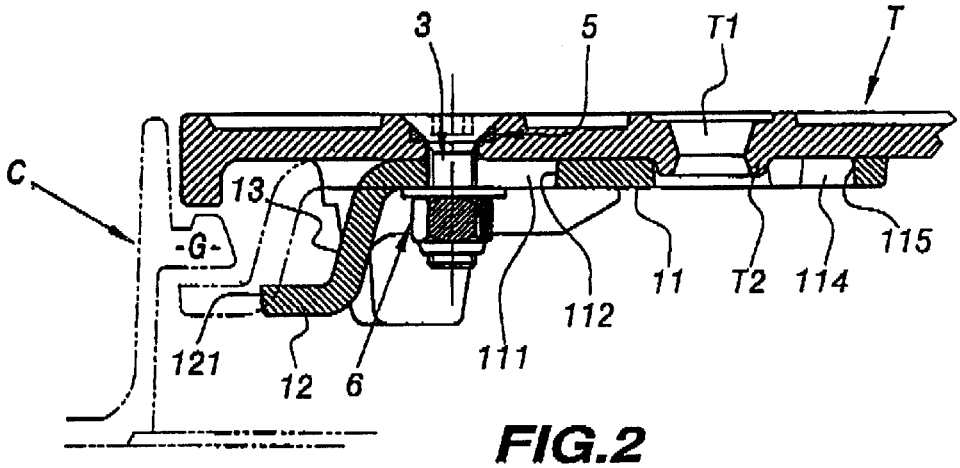
Figure 3:
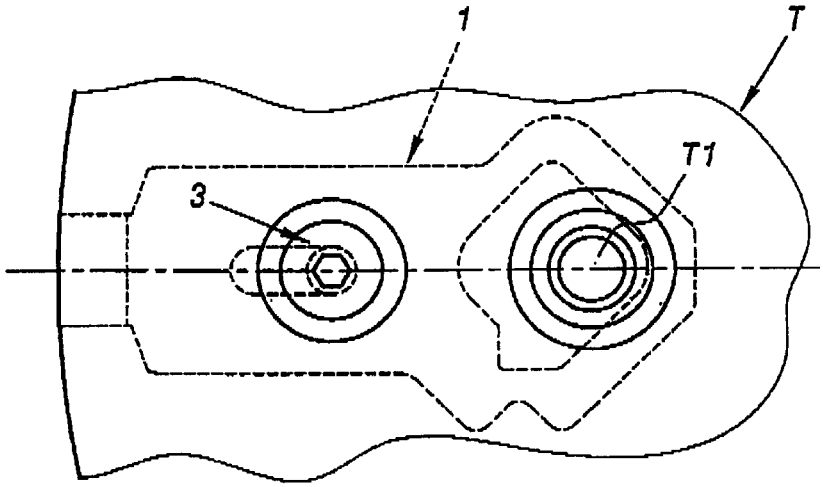
Figure 5:
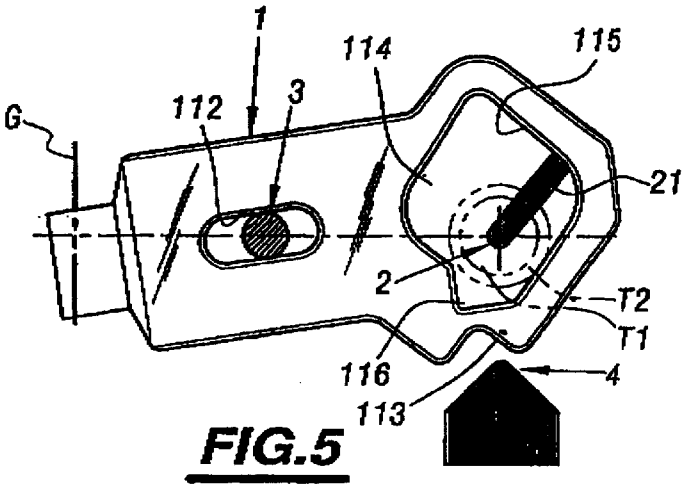
Figure 7:
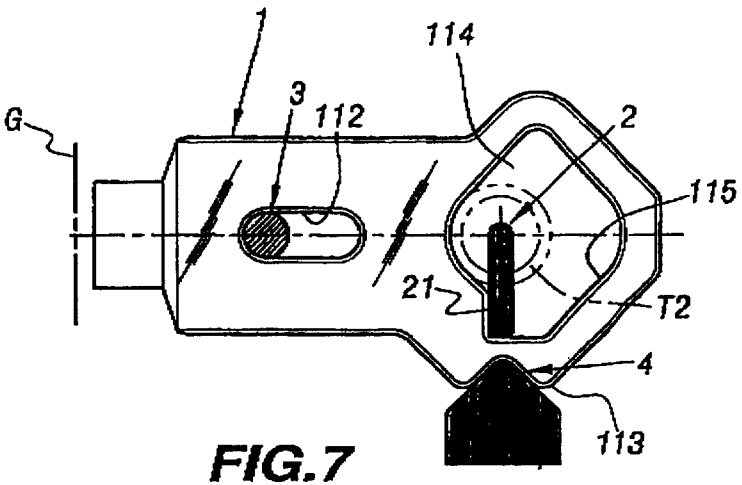
Figure 11:
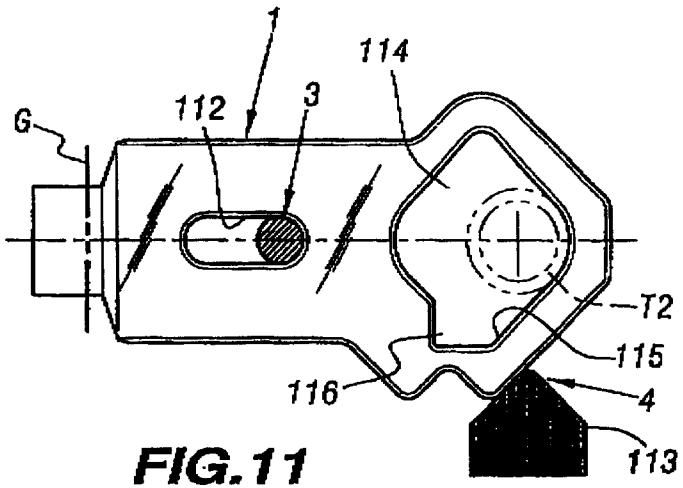
Figure 10:
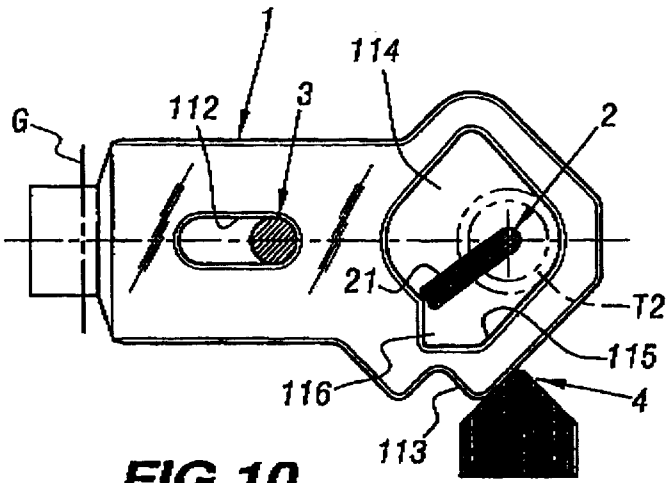
Figure 12:
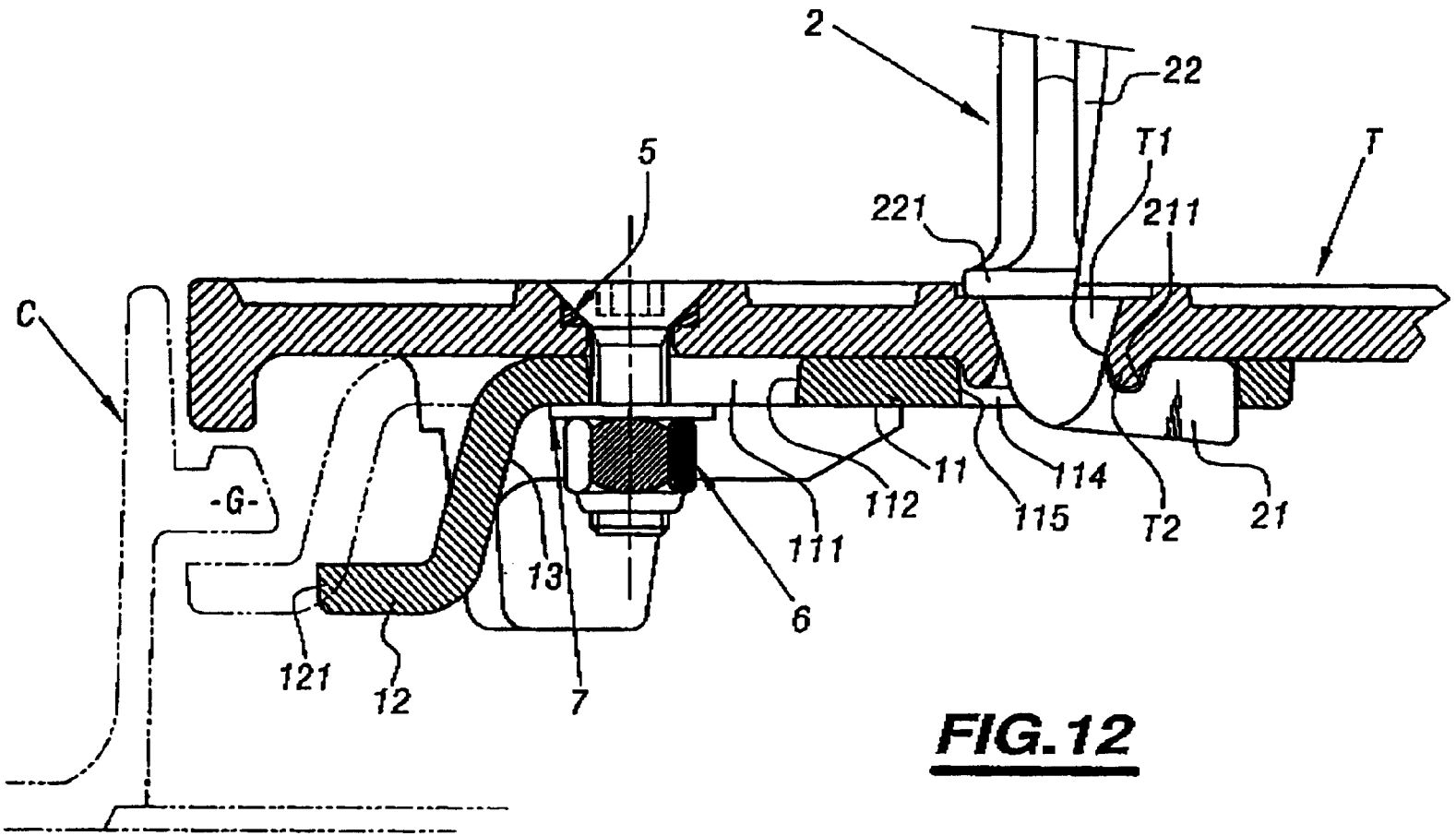

Other characteristics and advantages of the invention will become apparent from the following description of an embodiment of the invention given by way of nonlimiting example and illustrated by the accompanying drawings, in which:

FIG. 1 is a plan view of a bolt with which a locking device according to the invention is equipped, FIG. 2 is a view showing, in longitudinal section along the line II—II of FIG. 1, the bolt of this figure and part of a highway cover in the closed position, to which this bolt is secured in the cover-unlocking position, the members for fixing the bolt to the cover, and, in dot-dash lines, part of the frame of the cover and the bolt in the cover-locking position, FIG. 3 is a plan view of the same part of the cover equipped with the bolt, but the latter being shown in the cover-locking position, FIGS. 4 to 11 show, schematically in plan view, the successive relative positions of the bolt, the key bit, the keeper (shown schematically in a dot-dash line), and the members for guiding the locking device according to the invention when the bolt moves from its locking position to its unlocking position and then from this unlocking position to the locking position again, FIG. 12 is a view similar to FIG. 2 showing the arrangement in the bolt of part of the key with which the locking device according to the invention is equipped.

The locking device illustrated by the figures is intended to mutually lock a cover T, part of which is shown in FIGS. 2, 3 and 12, and a cover frame C, part of which is shown in dot-dash lines in FIGS. 2 and 12. Advantageously, the cover is provided with hinge means (not shown) opposite the locking device.

This locking device includes a bolt 1 and a key 2 (FIG. 12) adapted to selectively actuate the bolt from a locking position to an unlocking position, and vice versa, when, after being inserted into an aperture of the bolt, it is turned in one direction or in the opposite direction. The locking and unlocking positions of the bolt are respectively a position of the latter in which one of its end regions is confined under the keeper G carried by the cover frame C (in dot-dash lines in FIG. 2), the keeper projecting towards the inside of the frame, and a position of the bolt in which this end region is sufficiently offset from the keeper for the bolt to be no longer engaged at all under the keeper.

The device further includes two bolt-guiding members 3, 4 (FIGS. 4 to 11), which are carried here by the cover and adapted to cooperate respectively with two bolt-guiding ramps. One of the guiding members may consist of a screw 3 for securing the bolt to the cover; the other guiding member is a fixed finger 4 which may be in one piece with the cover, projecting under the lower surface of the latter and having a shape in the form of a 90° wedge, the vertex of which is turned towards a lateral face of the bolt as will be seen in more detail below. By virtue of this arrangement, the bolt does not need to be accommodated in a housing, the fouling of which might adversely affect the actuation of the bolt over time.

More precisely, the bolt 1 consists of an elongated metal plate bent at about a hundred degrees and bent in an opposite direction likewise at about a hundred degrees so that it has two flanges 11, 12 extending approximately parallel in opposite directions on either side of a connecting part 13 respectively. One of the flanges is an elongated guiding flange 11 adapted to be secured to the cover T by means of the screw 3 by being placed with moderate pressure against the lower face of the cover so that the bolt is rotationally movable about the axis of the screw and also translationally movable in a direction parallel to this lower face, and the other flange is a short locking flange 12 including the end region 121 adapted to cooperate with the keeper G of the frame C and denoted by "locking end region" hereinbelow.

To allow this mobility of the bolt, the guiding flange 11 is pierced with an oblong hole 111, through which is passed the screw 3, the width of which hole is slightly greater than the diameter of this screw, and the length of which hole, limited by two surfaces of the edge of the hole, against which the screw respectively abuts in the locking position and in the unlocking position of the bolt, extends along the longitudinal axis of the guiding flange and of the bolt. The wall 112 of the oblong hole, including the two locking and unlocking abutment surfaces, thus forms the first ramp for guiding the bolt relative to the guiding member consisting of the screw 3.

The second bolt-guiding ramp is intended to block the bolt when it is in the unlocking position and in the locking position, and consists of a region 113 of a lateral edge of the bolt which faces the fixed finger 4; this region 113 of the lateral edge of the bolt is situated close to the free end of the guiding flange 11, which is located opposite the locking end region 121; it has, seen in plan, the shape of a W, of which the central indentation separating the two Vs forms a receptacle for the finger 4 when the bolt is in the unlocking position and of which the lateral branch closest to the free end of the flange 11 forms an abutment against the finger 4 when the bolt is in the locking position.

The free end region of the guiding flange 11 further has passing right through it a key-inserting aperture 114 which does not open onto the periphery of the bolt and the wall 115 of which thus forms a third guiding ramp forming a driving profile adapted to cooperate with the contour of the key bit 21 when the latter is inserted into the aperture 114.

The aperture 114 has, seen in plan, a general shape approximately in the form of a square, the vertices of which are rounded and one side of which, starting from one of the vertices of the square, has an indentation 116 in the shape of a right-angled triangle. One of the diagonals of the square extends along the longitudinal axis of the guiding flange and of the bolt, and the other is aligned with the axis of symmetry of that of the two Vs of the W formed by the second ramp 113 which is the closest to the free end of the flange 11.

The rounded shape of the vertices of the square formed by the aperture 114 gives greater progressivity to the movement of the bolt upon its actuation by the key. The side of the square having the indentation 116 in the shape of a right-angled triangle is that which joins the vertex of the square closest to the oblong hole 111 to the vertex closest to the second ramp 113. The vertex of the square at which the indentation 116 arises is that which is close to the second ramp 113, and from which the diagonal which is on the axis of one V of the W formed by this second ramp starts; the side of the indentation 116 which arises at this vertex is perpendicular to this diagonal, and the second side of the indentation is parallel to this same diagonal; the edge of this second side thus forms an abutment for the key bit when the bolt is in the unlocking position; when the bit abuts against this edge, the key is in a position such that its gripping handle (not shown) is perpendicular to the longitudinal axis of the bolt and thus parallel to the hinge axis of the cover when the latter is equipped with a hinge, thus facilitating the lifting of the cover by means of the key.

In order that the bolt cannot be actuated by inserting any tool into the aperture 114 and rotating it, the cover has, facing this aperture 114, a frustoconical hole T1 with a diameter significantly smaller than the diagonal of the square of the aperture, thus preventing the shape of the aperture 114 which allows the driving of the bolt to be seen from outside; so that, on the one hand, the key can be inserted into this hole and, on the other hand, can cooperate with the third ramp 115 (wall of the aperture), it has a bent shape and its bit has a thickness and width which are relatively small; since the nultiple-ramp system of the bolt requires a high degree of precision of the positioning of the key, it is necessary for the rotational movement of the bit to be guided with accuracy and for the key shank 22 to remain perfectly perpendicular to the guiding flange 11 of the bolt during the rotation of the key. This rotational guidance of the key is ensured by the fact that the hole T1 has a frustoconical shape flared towards the outer face of the cover; moreover, a circular countersink surrounding the hole T1, on the outer side of the cover, improves the rotational guidance of the key. Moreover, the cover face against which the flange 11 is placed includes, around the frustoconical hole T1, a boss T2 in the shape of a circular crown concentric with the hole, and the key bit 21 has a notch 211, centred at a distance from the axis of rotation of the key equal to the mean radius of the projecting circular crown. In addition, the base of the key shank 22 includes a semicircular collar 221 intended to bear on the cover when the notch 211 is engaged with the boss T2. The bit 21 preferably extends approximately perpendicularly to the shank 22, its length being greater than the diameter of the hole T1, whereas its width and thickness are smaller than the diameter of this hole T1, and its region for connection to the collar 221 has a frustoconical surface having a groove with a curved bottom, at which the connecting region assumes a flat shape facilitating the insertion of the bit into the hole T1 when the key shank 22 is in a position virtually parallel to the upper face of the cover.

The result of this arrangement is that the rotation of the key 2 is effected about an axis perpendicular to the cover T and held in a fixed position relative to the latter.

The fact that the shape of the key-inserting hole T1 differs from the shape of the bit 21 makes it possible to conceal the particular profile of the key to be used to actuate the bolt and thus affords effective protection against "picking".

Figure 4:
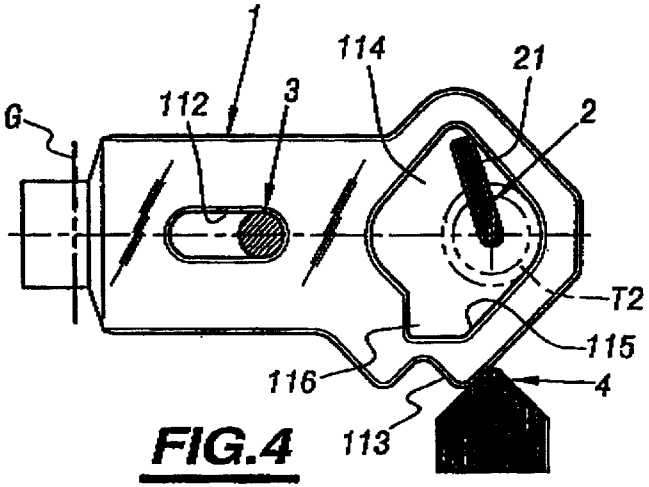

The boss T2 projecting inside the aperture 114 forms an obstacle to the access of the third ramp 116 in order to impede the insertion of a picking tool and acts as an abutment for the bolt, limiting the displacement thereof, and the radius of the "roundings" of the vertices of the square situated on the longitudinal axis of the bolt is approximately equal to the radius of the projecting crown forming the boss, so that the crown is lodged in the vertex on the side of the oblong hole when the bolt is in the unlocking position (FIGS. 7 and 8) and in the vertex on the side of the free end of the guiding flange when the bolt is in the locking position (FIGS. 4 and 11).

The length of the bit 21 (distance of the front surface thereof to the axis of the key shank 22) is equal to half the diagonal of the square (FIGS. 7 and 8), the dimensions of the hole T1 being significantly smaller than the length of the bit.

By virtue of the fit of the key 2 in the cover T and the strict positioning of the aperture 114 of the bolt 1 relative to the cover, the frustoconical surface of the hole T1 of the covet provides an effective support reaction to the thrust of the front face of the bit 21 against the wall 115 of the aperture 114 for the actuation of the bolt.

The securing of the bolt 1 to the cover 2 is effected, as has been seen, by the screw 3 passing through a through-hole machined in the cover, the frustoconical head of which bears on an elastic member 5 inserted into a countersink of this through-hole, the compression of the member 5 ensuring the optimum pressure of the bolt for its operation; opposite the screw head, a locknut 6 is screwed around the body of the screw, and a thrust washer 7 interposed between the locknut and the guiding flange 11 of the bolt receives this flange, bearing around the oblong hole 111; by virtue of this assembly, the screw 3 can turn freely, without this rotation loosening the locknut and thus bringing about the release of the bolt; thus, to demount the bolt, it is necessary to act simultaneously on the head of the screw 3 and on the locknut situated under the bolt, the locknut being inaccessible from outside when the cover is in the closed position.

The operation of the device upon unlocking and locking results from the conjunction:

- of the guidance of the ramp 112 of the oblong hole 111 by the screw 3,
- of the guidance of the W-shaped ramp 113 by the finger 4,
- of the guidance of the ramp 115 of the aperture 114 by the key bit 21,
- causing, on account of the approximately square shape of the aperture 114, a movement of the bolt in a substantially quadratic path.

To facilitate the understanding of the kinematics of the movement, the boss in the shape of a crown T2 is shown in fine dot-dash lines and the free end of the keeper G is symbolised in a thick dot-dash line, in FIGS. 4 to 11.

When the bolt is in the locking position (FIG. 4), the end of the oblong hole 111 on the side of the aperture 114 is substantially abutting against the screw 3, whereas the part of the ramp 113 on the side of the free end of the guiding flange 11 is abutting against the inclined face of the finger 4 on the side of the keeper; the longitudinal axis of the bolt in this case coincides with the straight line passing through the centre of the through-hole of the cover for the screw 3 and the centre of the hole T1, and the boss T2 is abutting against the rounded wall of the aperture on the side of the free end of the guiding flange 11.

If the key bit 21 is inserted into the aperture 114, the only possibility for moving the bolt is to turn the key clockwise until the bit pushes a section of the ramp 115 opposite the finger 4 on the side of the free end of the guiding flange 11; the result of this rotation of the key is that the second ramp 113 slides against the finger 4 in the direction of the vertex thereof, until the longitudinal axis of the bolt is sufficiently inclined, relative to the straight line passing through the centre of the hole for the screw 3 and the centre of the hole T1, for the second ramp 113 to be completely disengaged from the finger 4 (FIG. 5); the screw 3 is in this case approximately midway along the length of the oblong hole 111; in the course of this manoeuvre, the bolt is partially freed from the hold of the keeper.

Figure 6:
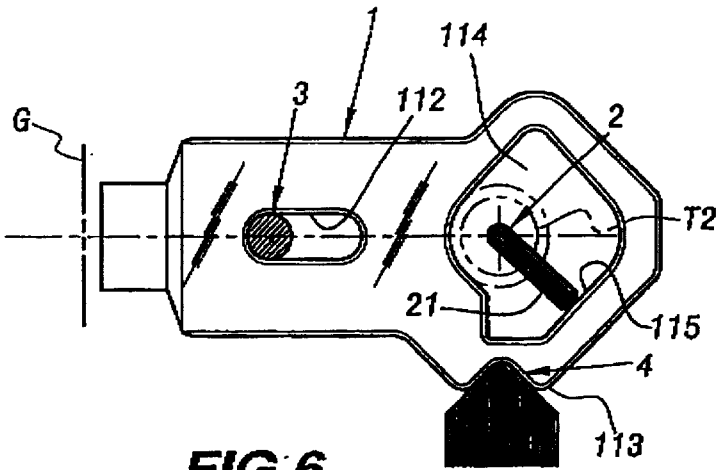
Figure 9:
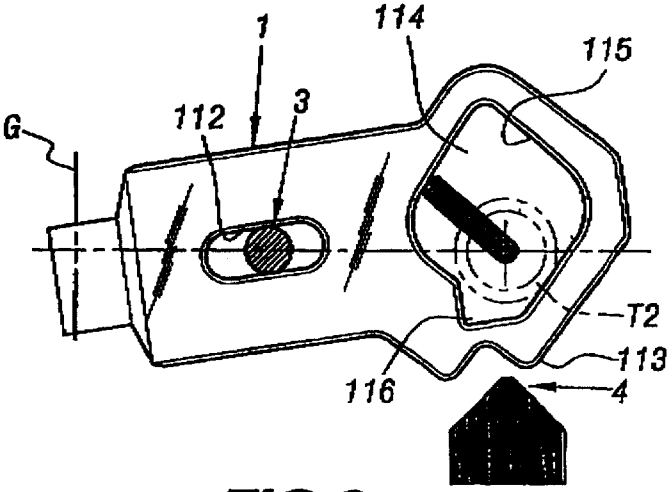
Figure 8:
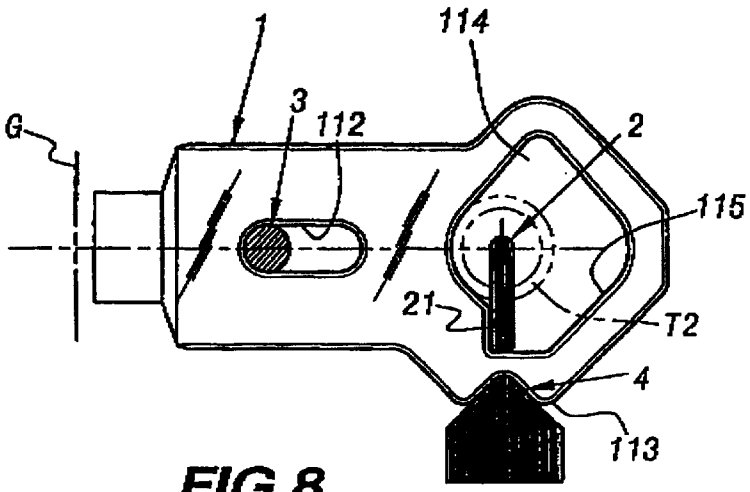

If the clockwise rotation of the key is continued, the front face of the bit pushes a section of the third ramp 115 on the side of the finger 4, and the indentation of the second ramp 113 envelops the finger, whereas the longitudinal axis of the bolt returns to the position which it occupies when the bolt is in the locking position; at the end of this movement, the end of the length of the oblong hole 111 on the side of the keeper is substantially abutting against the screw 3 (FIG. 6).

By continuing the rotation of the key, the front face of its bit comes into abutment with the bottom of the indentation 116 of the aperture 114, and this provides assurance that the bolt is in the unlocking position (FIG. 7); the bit can then be withdrawn from the aperture 114 by inclining the key shank or the key can be used as a gripping tool for lifting the cover.

To lock the bolt, the key bit is inserted into the aperture 114 in the same way as above (FIG. 8), but the only possibility for moving the bolt is to turn the key anticlockwise until the bit pushes a section of the ramp 115 also opposite the finger 4 but on the keeper side of the guiding flange 11; the result of this rotation of the key is that the bottom of the indentation of the second ramp 113 moves away from the finger 4 and the bolt slides in the direction of the keeper, until the longitudinal axis of the bolt is sufficiently inclined, relative to the straight line passing through the centre of the hole for the screw 3 and the centre of the hole T1, for the second ramp 113 to be completely disengaged from the finger 4 (FIG. 9); the screw 3 is in this case approximately midway along the length of the oblong hole 111.

If the anticlockwise rotation of the key is continued, the front face of the bit pushes a section of the third ramp 115 on the side of the finger 4, until the time when the bit reaches the indentation 116 of the aperture 114 (FIG. 10),. the bolt then being in the locking position, in which position the part of the second ramp 113 on the side of the free end of the guiding flange 11 is abutting against the inclined face of the finger 4 on the side of the keeper, the longitudinal axis of the bolt again coincides with the straight line passing through the centre of the hole for the screw 3 and the centre of the hole T1, the boss T2 is abutting against the rounded wall 115 of the aperture 114 on the side of the free end of the flange 11, and the end of the oblong hole 111 on the side of the aperture 114 is substantially abutting against the screw 3. Continuing the rotation of the key has no effect until it comes into abutment; it is therefore possible to withdraw the key, and the bolt remains locked (FIG. 11).

It will be noted that the locking device according to the invention is economical, compact and not very sensitive to the environment, since the rotation of the key in the locking direction or in the unlocking direction acts directly on the bolt and causes only the movement of the bolt, in contrast to the traditional mechanism where the rotation of the key brings about the additional movement of other parts coupled to the bolt.

It will also be noted that, by virtue of the mode of assembly by means of the screw 3 and the locknut, the bolt is not demountable from outside. Moreover, by virtue of the small diameter of the hole T1, it is impossible to observe the mode of actuation of the bolt. Finally, by virtue of the boss T2 projecting under the cover around the hole T1, it is difficult to access the ramp 115 of the aperture 114 and thus "pick" the lock, and by virtue of the frustoconical shape of the hole T1, the "picking" difficulty is further increased.

What is claimed is:

1. A locking device for mutually locking a first and second element, comprising:

a covering element (T); and a support frame (C) supporting the covering element, a movable bolt (1) shaped to interface with a separate key (2) for actuating the bolt; and first and second bolt-guiding members (3, 4) carried by one of the covering element and second the support frame (T, C), wherein the bolt (1) comprises a key-inserting aperture (114), first and second guiding ramps (112, 113) adapted to cooperate with the first and second guiding members (3, 4) respectively, and a third guiding ramp (115) adapted to cooperate with a contour of the key (2) when the key is inserted into the aperture (114), in order to selectively actuate the bolt (1) from a locking position to an unlocking position and from an unlocking position to a locking position, by rotation of the key (2); and the second bolt-guiding member (4) is carried by the covering element (T) and formed by a wedge-shaped finger, and the second guiding ramp (113) adapted to cooperate with this member is a region of a lateral edge of the bolt including an indentation forming a receptacle for the finger (4), so as to block the bolt (1) in the locking position and in the unlocking position.

2. A locking device according to claim 1, wherein:

the first bolt-guiding member (3) is carried by the covering element (T) and is formed by a member for securing the bolt to the covering element, and the first guiding ramp (112) adapted to cooperate with this member is a wall of an oblong hole (111) which is made in the bolt and into which the securing and guiding member (3) is inserted.

3. A locking device according to claim 2, wherein:

the securing and guiding member (3) is a screw, the body of which is passed through the oblong hole and carries a locknut (6) situated under the bolt.

4. A locking device according to claim 1, wherein:

the wedge-shaped finger is in one piece with the covering element (T) and extends in a manner projecting from a bottom face thereof.

5. A locking device according to claim 1, wherein:

the third guiding ramp (115) adapted to cooperate with the contour of the key consists of the lateral wall of the aperture (114), this lateral wall being adapted to cooperate with a key bit (21) when the latter is inserted into the aperture (114).

6. A locking device according to claim 5, wherein:

the aperture (114) has an indentation (116), one edge of which forms an abutment for the bit (21) when the bolt is in the unlocking position.

7. A locking device according to claim 5, wherein:

the bit (21) has a notch (211) adapted to come into engagement with a boss (T2) in the shape of a circular crown surrounding a hole (T1) for inserting the key (2), made in the first element (T) and situated facing the aperture (114), this boss projecting into the aperture (114) and also cooperating with the third guiding ramp (115).

8. A locking device according to claim 7, wherein:

the hole (T1) has a frustoconical shape flared towards the outer face of the covering element (T) and adapted to cooperate with a complementary frustoconical surface of the key (2), so as to ensure the rotational guidance of the key.

9. A locking device according to claim 8, wherein:

the frustoconical hole (T1) has a major diameter significantly smaller than the aperture (114).

10. A locking device according to claim 5, wherein:

the key (2) includes, at the base of a shank (22), a collar (221) intended to bear on the covering element (T), and the region for connection of the bit (21) to the collar (221) has a frustoconical surface adapted to cooperate with a frustoconical surface of a hole (T1) of the covering element (T).

11. A locking device for mutually locking a first and second element, comprising:

a covering element (T); and a support frame (C) supporting the covering element, a movable bolt (1) shaped to interface with a separate key (2) for actuating the bolt; and first and second bolt-guiding members (3, 4) carried by one of the covering element and the support frame (T, C), wherein:

the bolt (1) comprises a key-inserting aperture (114), first and second guiding ramps (112, 113) adapted to cooperate with the first and second guiding members (3, 4) respectively, and a third guiding ramp (115) adapted to cooperate with a contour of the key (2) when the key is inserted into the aperture (114), in order to selectively actuate the bolt (1) from a locking position to an unlocking position and from an unlocking position to a locking position, by rotation of the key (2);

the third guiding ramp (115) adapted to cooperate with the contour of the key consists of the lateral wall of the aperture (114), this lateral wall being adapted to cooperate with a key bit (21) when the latter is inserted into the aperture (114);

the bit (21) has a notch (211) adapted to come into engagement with a boss (T2) in the shape of a circular crown surrounding a hole (T1) for inserting the key (2), made in the first element (T) and situated facing the aperture (114), this boss projecting into the aperture (114) and also cooperating with the third guiding ramp (115); and the hole (T1) has a frustoconical shape flared towards the outer face of the covering element (T) and adapted to cooperate with a complementary frustoconical surface of the key (2), so as to ensure the rotational guidance of the key.

12. A locking device according to claim 11, wherein:

the frustoconical hole (T1) has a major diameter significantly smaller than the aperture (114).

13. A locking device for mutually locking a first and second element, comprising:

a covering element (T); and a support frame (C) supporting the covering element, a movable bolt (1) shaped to interface with a separate key (2) for actuating the bolt; and first and second bolt-guiding members (3, 4) carried by one of the covering element and the support frame (T, C), wherein:

the bolt (1) comprises a key-inserting aperture (114), first and second guiding ramps (112, 113) adapted to cooperate with the first and second guiding members (3, 4) respectively, and a third guiding ramp (115) adapted to cooperate with a contour of the key (2) when the key is inserted into the aperture (114), in order to selectively actuate the bolt (1) from a locking position to an unlocking position and from an unlocking position to a locking position, by rotation of the key (2);

the third guiding ramp (115) adapted to cooperate with the contour of the key consists of the lateral wall of the aperture (114), this lateral wall being adapted to cooperate with a key bit (21) when the latter is inserted into the aperture (114); and the key (2) includes, at the base of a shank (22), a collar (221) intended to bear on the covering element (T), and the region for connection of the bit (21) to the collar (221) has a frustoconical surface adapted to cooperate with a frustoconical surface of a hole (T1) of the covering element (T).

* * * * *